US009005376B2

(12) United States Patent
Gong et al.

(10) Patent No.: US 9,005,376 B2
(45) Date of Patent: Apr. 14, 2015

(54) AMORPHOUS ALLOYS HAVING ZIRCONIUM AND METHODS THEREOF

(75) Inventors: Qing Gong, Shenzhen (CN); Faliang Zhang, Shenzhen (CN); Yongxi Jian, Shenzhen (CN)

(73) Assignee: BYD Company Limited (CN)

( * ) Notice: Subject to any disclaimer, the term of this patent is extended or adjusted under 35 U.S.C. 154(b) by 191 days.

(21) Appl. No.: 13/307,799

(22) Filed: Nov. 30, 2011

(65) Prior Publication Data

US 2012/0073706 A1 Mar. 29, 2012

Related U.S. Application Data

(63) Continuation of application No. 12/904,497, filed on Oct. 14, 2010, now abandoned.

(30) Foreign Application Priority Data

Oct. 26, 2009 (CN) ..... 2009 1 0180689

(51) Int. Cl.

| | |
|---|---|
| ***C22C 45/00*** | (2006.01) |
| ***C22C 45/10*** | (2006.01) |
| ***C22C 16/00*** | (2006.01) |
| ***B22D 27/00*** | (2006.01) |
| ***B22D 27/15*** | (2006.01) |
| ***C22C 1/00*** | (2006.01) |
| ***C22C 1/02*** | (2006.01) |

(52) U.S. Cl.

CPC ..... *C22C 45/10* (2013.01); *B22D 27/003* (2013.01); *B22D 27/15* (2013.01); *C22C 16/00* (2013.01); *C22C 1/002* (2013.01); *C22C 1/02* (2013.01)

(58) Field of Classification Search

CPC ..... C22C 1/002; C22C 1/02; C22C 16/00; C22C 45/10; B22D 27/003; B22D 27/15

USPC ..... 420/423; 164/47, 66.1, 113; 148/403, 148/561

See application file for complete search history.

(56) References Cited

U.S. PATENT DOCUMENTS

| | | | |
|---|---|---|---|
| 5,288,344 | A | 2/1994 | Peker et al. |
| 5,368,659 | A | 11/1994 | Peker et al. |
| 5,797,443 | A | 8/1998 | Lin et al. |
| 6,374,899 | B1 | 4/2002 | Yamaguchi et al. |
| 6,562,156 | B2 | 5/2003 | Liu |
| 6,682,611 | B2 | 1/2004 | Zhang et al. |
| 6,709,536 | B1 | 3/2004 | Kim et al. |
| 6,805,758 | B2 | 10/2004 | Wolter |
| 6,896,750 | B2 | 5/2005 | Wolter |
| 7,008,490 | B2 | 3/2006 | Peker |
| 7,153,376 | B2 | 12/2006 | Wolter |
| 7,244,321 | B2 | 7/2007 | Kim et al. |
| 7,357,731 | B2 | 4/2008 | Johnson et al. |
| 2003/0075246 | A1 | 4/2003 | Peker |
| 2003/0217790 | A1 | 11/2003 | Wolter |
| 2004/0084114 | A1 | 5/2004 | Wolter |
| 2004/0216812 | A1 | 11/2004 | Wolter |
| 2006/0108033 | A1 | 5/2006 | Peker et al. |
| 2006/0154745 | A1 | 7/2006 | Johnson et al. |
| 2007/0107810 | A1 | 5/2007 | Farmer |
| 2007/0131312 | A1 | 6/2007 | Kim et al. |
| 2008/0190521 | A1 | 8/2008 | Loffler et al. |
| 2009/0139612 | A1 | 6/2009 | Lu et al. |
| 2011/0094633 | A1 | 4/2011 | Gong et al. |
| 2011/0097237 | A1 | 4/2011 | Gong et al. |
| 2011/0280761 | A1 | 11/2011 | Gong et al. |
| 2011/0308671 | A1 | 12/2011 | Gong et al. |
| 2012/0067466 | A1 | 3/2012 | Gong et al. |
| 2012/0073706 | A1 | 3/2012 | Gong et al. |
| 2012/0073707 | A1 | 3/2012 | Gong et al. |
| 2012/0073709 | A1 | 3/2012 | Gong et al. |

FOREIGN PATENT DOCUMENTS

| | | | |
|---|---|---|---|
| CN | 1548572 | A | 11/2004 |
| EP | 2103699 | A1 * | 9/2009 |
| JP | 2000234156 | A | 8/2000 |
| WO | WO 2010130199 | A1 | 11/2010 |
| WO | WO 2011050695 | A1 | 5/2011 |

OTHER PUBLICATIONS

Patent Abstracts of Japan; Abstract for Japanese Publication No. 2000-234156; Downloaded from www.19.ipdl.inpit.go.jp/PA1/result/detail/main/wj6ljyaDA412234156P1.htm; Aug. 29, 2000; One page; Japan.

Jiang, F. et al.; "Formation of Zr-Based Bulk Metallic Glasses from Low Purity Materials by Scandium Addition;" Scripta Materialla, vol. 53, pp. 487-491; Jun. 2005.

Patent Cooperation Treaty; International Search Report Issued in Connection with International Application No. PCT/CN2010/072643; Aug. 12, 2010; 2 pages; China.

Patent Cooperation Treaty; PCT Written Opinion of the International Searching Authority; Issued in Connection with International Application No. PCT/CN2010/072643; Aug. 12, 2010; 3 pages; China.

Patent Cooperation Treaty; International Search Report Issued in Connection with International Application No. PCT/CN2010/078014; Jan. 27, 2011; 5 pages; China.

Patent Cooperation Treaty; PCT Written Opinion of the International Searching Authority; Issued in Connection with International Application No. PCT/CN2010/078014; Jan. 27, 2011; 6 pages; China.

U.S. Patent and Trademark Office; Non-Final Office Action Issued Against U.S. Appl. No. 12/890,063; Jan. 26, 2012; 9 pages; U.S.A.

U.S. Patent and Trademark Office; Non-Final Office Action Issued Against U.S. Appl. No. 13/310,128; Jan. 30, 2012; 9 pages; U.S.A.

U.S. Patent and Trademark Office; Non-Final Office Action Issued Against U.S. Appl. No. 13/148,725; Mar. 1, 2012; 9 pages; U.S.A.

U.S. Patent and Trademark Office; Non-Final Office Action Issued Against U.S. Appl. No. 13/310,018; Mar. 5, 2012; 8 pages; U.S.A.

Faliang Zhang; "Declaration Under 37 C.F.R § 1.132 of Faliang Zhang;" Jun. 4, 2012; 27 pages; U.S.A.

(Continued)

*Primary Examiner* — Roy King
*Assistant Examiner* — Caitlin Kiechle
(74) *Attorney, Agent, or Firm* — Greenberg Traurig, LLP

(57) ABSTRACT

Alloys and methods for preparing the same are provided. The alloys are represented by the general formula of $(Zr_aAl_bCu_cNi_d)_{100-e-f}Y_eM_f$ wherein a, b, c, and d are atomic fractions, in which: $0.472 \le a \le 0.568$; $0.09 \le b \le 0.11$; $0.27 \le c \le 0.33$; $0.072 \le d \le 0.088$; the sum of a, b, c, and d equals 1; e and f are atomic numbers of elements Y and M respectively, in which $0 \le e \le 5$ and $0.01 \le f \le 5$; and M is selected from the group consisting of Nb, Ta, Sc, and combinations thereof.

16 Claims, 1 Drawing Sheet

(56) References Cited

OTHER PUBLICATIONS

He Lin et al., Effect of Oxygen on the Thermal Stability of Zr—Cu—Ni—Al—Ti Bulk Amorphous Alloy; Feb. 2006; vol. 42, No. 2; pp. 134-138; ACTA Metallurgica Sinica.

U.S. Patent and Trademark Office; Non-Final Office Action Issued Against U.S. Appl. No. 12/904,497; Feb. 6, 2012; 13 pages; U.S.A.

U.S. Patent and Trademark Office; Final Office Action Issued Against U.S. Appl. No. 12/904,497; Jul. 23, 2012; 10 pages; U.S.A.

* cited by examiner

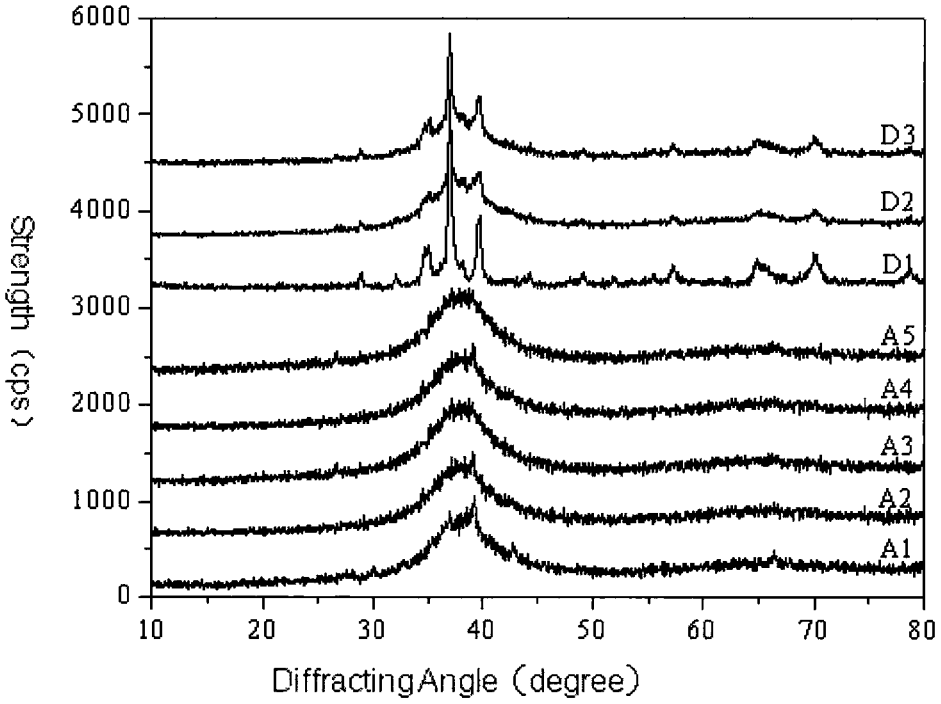
6000
5000
4000
3000
2000
1000
0
Strength (cps)
D3
D2
D1
A5
A4
A3
A2
A1
10
20
30
40
50
60
70
80
Diffracting Angle (degree)

AMORPHOUS ALLOYS HAVING ZIRCONIUM AND METHODS THEREOF

CROSS-REFERENCE TO RELATED APPLICATION

This application is a continuation of prior U.S. patent application Ser. No. 12/940,497, filed on Oct. 14, 2010, now abandoned, which claims the priority and benefit of Chinese Patent Application No. 200910180689.X filed with State Intellectual Property Office, P.R.C. on Oct. 26, 2009.

FIELD

The present disclosure relates generally to amorphous alloys, and methods for preparing the same. More particularly, the present disclosure relates to amorphous alloys having Zr and methods for preparing the same.

BACKGROUND

Amorphous metallic alloys may have a generally disordered atomic-scale structure, which is in contrast to most metals that are often crystalline and have a generally organized atomic-scale structure. Amorphous metallic alloys may otherwise be referred to as "metallic glasses" or "glassy metals." Such alloys may be used in connection with a wide variety of applications, including, without limitation, in connection with golf clubs, industrial coatings and overlays, and cellular telephone technology.

SUMMARY

In accordance with various illustrative embodiments hereinafter disclosed are alloys, which may be represented by the general formula of: $(Zr_aAl_bCu_cNi_d)_{100-e-f}Y_eM_f$, wherein a, b, c, and d are atomic fractions, in which $0.472 \le a \le 0.568$; $0.09 \le b \le 0.11$; $0.27 \le c \le 0.33$; $0.072 \le d \le 0.088$, and the sum of a, b, c, and d equals to 1; e and f are atomic numbers of elements Y and M respectively, in which $0 \le e \le 5$, and $0.01 \le f \le 5$; and M is selected from the group consisting of Nb, Ta, Sc, and combinations thereof.

In accordance with another illustrative embodiment hereinafter disclosed are methods of preparing alloys. The method may include melting raw materials comprising Zr, Al, Cu, Ni, M, and optionally Y, to form a melted alloy. The method may further include molding the melted alloy with cooling to form an alloy, wherein the alloy is represented by the general formula of: $(Zr_aAl_bCu_cNi_d)_{100-e-f}Y_eM_f$; wherein a, b, c, and d are atomic fractions, in which $0.472 \le a \le 0.568$; $0.09 \le b \le 0.11$; $0.27 \le c \le 0.33$; $0.072 \le d \le 0.088$, and the sum of a, b, c, and d equals to 1; e and f are atomic numbers of elements Y and M respectively, in which $0 \le e \le 5$, and $0.01 \le f \le 5$; and M is selected from the group consisting of Nb, Ta, Sc, and combinations thereof.

While alloys such as amorphous alloys, and methods thereof, will be described in connection with various preferred illustrative embodiments, it will be understood that this disclosure is not intended to limit the alloys and methods thereof to those embodiments. On the contrary, this disclosure is intended to cover all alternatives, modifications, and equivalents as may be included within the spirit and scope of the alloys and methods as defined by the appended claims. Further, in the interest of clarification and without limitation, the numerical ranges provided herein are intended to be inclusive of all alternative ranges. As a non-limiting example, where a ratio of "about 1:about 0.1 to about 5" is provided, it is intended to disclose all intermediate ratios, including 1:0.11, 1:0.25, 1:1.3, 1:4.95, etc.

BRIEF DESCRIPTION OF THE DRAWING

These and other aspects and advantages of the present disclosure will become apparent and more readily appreciated from the following descriptions taken in conjunction with the drawing, in which:

FIG. 1 illustrates an X-ray diffraction pattern of exemplary and comparative alloys of the present disclosure.

DETAILED DESCRIPTION OF THE EMBODIMENT

According to an aspect of the present disclosure, an alloy is provided which may include zirconium. The alloy may further be represented by the following general formula: $(Zr_aAl_bCu_cNi_d)_{100-e-f}Y_eM_f$, wherein a, b, c, and d are atomic fractions, in which $0.472 \le a \le 0.568$; $0.09 \le b \le 0.11$; $0.27 \le c \le 0.33$; $0.072 \le d \le 0.088$, and the sum of a, b, c, and d equals to 1; e and f are atomic numbers of elements Y and M respectively, in which $0 \le e \le 5$, and $0.01 \le f \le 5$; and M is selected from the group consisting of Nb, Ta, Sc, and combinations thereof. Alternatively, M may be selected from the group consisting of: Sc, the combination of Sc and Nb, the combination of Sc and Ta, or the combination of Sc, Nb and Ta. In a further alternative embodiment, the atomic ratio of Sc to Nb ranges from about 1:from about 0.1 to about 5, the atomic ratio of Sc to Ta ranges from about 1:from about 0.1 to about 5, and the atomic ratio of Sc:Nb:Ta ranges from about 1:from about 0.1 to about 5:from about 0.1 to about 10.

In an embodiment, the alloy may include metal and/or non-metal impurities. Preferably, the atomic percent of metal impurities, if present, is less than about 5 weight percent, and the atomic percent of non-metal impurities, if present, is less than about 1 weight percent, based on the total weight of the alloy. In an embodiment, the alloys of the present disclosure may have an oxygen content of less than about 3000 parts per million.

In various embodiments, the alloys described herein may be described as amorphous alloy(s). For the purposes of this disclosure, an "amorphous alloy" may mean a metallic alloy having a non-crystalline disordered atomic-scale structure. In an embodiment, the alloys of the present disclosure may have a crystalline phase with a volume percent of less than about 12%, based on the total volume of the alloy. In an embodiment, the alloys of the present disclosure may have a critical size, as defined in the "testing" description below, of more than about 3 millimeters, and alternatively the critical size of the alloys of the present disclosure may range from about 5 millimeters to about 18 millimeters.

According to another aspect of the present disclosure, methods for preparing the above-described alloys are provided. The methods may include melting raw materials comprising Zr, Al, Cu, Ni, M, and optionally Y, to form a melted alloy; and molding the melted alloy, while cooling it, to form the alloys as described above. Preferably, the metallic raw materials, such as for example, Zr, Al, Cu, Ni, M, and optionally Y, used in the preparation of alloys of the present disclosure each have a purity ranging from about 98 weight percent to about 100 weight percent.

Without wishing to be bound by the theory, Applicant believes that processing the alloys under vacuum conditions and/or in the presence of an inert gas may prevent the raw materials from being oxidized. Suitable inert gases may be selected from the group consisting of helium, neon, argon, krypton, xenon, radon, and combinations thereof. The inert gas may have a purity of more than 95% by volume, alternatively the inert gas may have a purity ranging from about 95% to about 99.9%, by volume. In an embodiment, before providing the inert gas into the melting furnace, the melting furnace may be vacuumized to a vacuum degree of less than about 1,000 Pa, alternatively less than about 100 Pa.

The melting step may be achieved by any known method in the art, provided that the raw materials are melted sufficiently. In an embodiment of the present disclosure, the melting step may be performed in a conventional melting device, such as an arc melting furnace, an induction melting furnace or a vacuum resistance furnace. The melting temperature and the melting times may vary according to the different raw materials. In an embodiment of the present disclosure, the melting step may be performed at a temperature ranging from of about 1,200° C. to about 3,000° C., alternatively from about 1,500° C. to about 2,500° C. In an embodiment, the raw materials may be melted for a time ranging from about 0.5 minutes to about 30 minutes, alternatively from about 1 minute to about 10 minutes. In an alternative embodiment, the raw materials may be subjected to multiple melting cycles.

The molding step may be realized by any conventional pressure casting method in the art, such as the method of casting the melted alloy in a mold with cooling. In some embodiments of the present disclosure, the pressure casting may be gravity casting, positive pressure casting, negative pressure casting, or high pressure casting. In an embodiment, high pressure casting may be performed under a pressure ranging from about 2 MPa to about 20 MPa. In an embodiment, the mold may be made from copper alloys, stainless steels, and materials having a thermal conductivity ranging from about 30 W/(m·K) to about 400 W/(m·K), alternatively from about 50 W/(m·K) to about 200 W/(m·K). The mold may be cooled by a cooling liquid such as, water or oil.

The present disclosure will be described in detail with reference to the following embodiments.

Example 1

An alloy represented by the formula of $(Zr_{0.52}Al_{0.1}Cu_{0.3}Ni_{0.08})_{99}Y_{0.5}Nb_{0.5}$ was prepared as follows:

About 47.5557 grams ("g") of Zr, about 2.7048 grams of Al, about 19.1117 grams of Cu, about 4.7073 grams of Ni, about 0.4501 grams of Y, and about 0.4704 grams of Nb were weighed and placed in an arc melting furnace. The arc melting furnace was vacuumed until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous alloy sample A1 with a size of 200 millimeters ("mm")×10 mm×3 mm. The Zr-based bulk amorphous Alloy Sample No. A1 was analyzed using Inductively Coupled Plasma Atomic Emission Spectrometer (ICP-AES) and was determined to have the following composition: $(Zr_{0.52}Al_{0.1}Cu_{0.3}Ni_{0.08})_{99}Y_{0.5}Nb_{0.5}$.

Example 2

An alloy represented by the formula of $(Zr_{0.52}Al_{0.52}Cu_{0.3}Ni_{0.08})_{98.5}Y_{0.5}Nb_1$ was prepared as follows:

About 47.2549 grams ("g") of Zr, about 2.6877 g of Al, about 18.9908 g of Cu, about 4.6775 g of Ni, about 0.4496 g of Y, and about 0.9396 g of Nb were weighed and placed in an arc melting furnace. The arc melting furnace was vacuumized until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous Alloy Sample No. A2 with a size of 200 millimeters ("mm")×10 mm×3 mm. The Zr-based bulk amorphous alloy sample A2 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{98.5}Y_{0.5}Nb_1$.

Example 3

An alloy represented by the formula of $(Zr_{0.52}Al_{0.1}Cu_{0.3}Ni_{0.08})_{97.5}Y_{0.5}Ta_2$ was prepared as follows:

About 45.5761 grams ("g") of Zr, about 2.5922 g of Al, about 18.3162 g of Cu, about 4.5133 g of Ni, about 0.4380 g of Y, and about 3.5662 g of Ta were weighed and placed in an arc melting furnace. The arc melting furnace was vacuumed until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous Alloy Sample No. A3 with a size of 200 millimeters ("mm")×10 mm×3 mm. The Zr-based bulk amorphous alloy sample A3 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{97.5}Y_{0.5}Ta_2$.

Example 4

An alloy represented by the formula of $(Zr_{0.52}Al_{0.1}Cu_{0.3}Ni_{0.08})_{99}Y_{0.5}Sc_{0.5}$ was prepared as follows:

About 47.7101 grams ("g") of Zr, about 2.7136 g of Al, about 19.1738 g of Cu, about 4.7226 g of Ni, about 0.4516 g of Y, and about 0.225 g of Sc were weighed and, placed in an arc melting furnace. The arc melting furnace was vacuumed until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous alloy sample A4 with a size of 200 millimeter ("mm")×10 mm×3 mm. The Zr-based bulk amorphous alloy sample A4 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{99}Y_{0.5}Sc_{0.5}$.

Example 5

An alloy represented by the formula of $(Zr_{0.52}Al_{0.1}Cu_{0.3}Ni_{0.08})_{98.7}Y_{0.3}Nb_{1/3}Sc_{1/3}Ta_{1/3}$ was prepared as follows.

About 47.2847 grams ("g") of Zr, about 2.6894 g of Al, about 19.0028 g of Cu, about 4.6805 g of Ni, about 0.2694 g of Y, about 0.3128 g of Nb, about 0.1513 g of Sc, and about 0.6091 g of Ta were weighed and placed in an arc melting furnace. The arc melting furnace was vacuumed until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous alloy sample A5 with a size of 200 millimeters ("mm")×10 mm×3 mm. The Zr-based bulk amorphous Alloy Sample No. A5 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{98.7}Y_{0.3}Nb_{1/3}Sc_{1/3}Ta_{1/3}$.

Example 6

An alloy represented by the formula of $(Zr_{0.52}Al_{0.1}Cu_{0.3}Ni_{0.08})_{97.5}Y_{0.5}Sc_1Nb_1$ was prepared as follows:

About 46.9583 g of Zr, about 2.6708 g of Al, about 18.8716 g of Cu, about 4.6481 g of Ni, about 0.4513 g of Y, about 0.4564 g of Sc, and about 0.9443 g of Nb were weighed and placed in an arc melting furnace. The arc melting furnace was vacuumized until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous Alloy Sample No. A6 with a size of 200 millimeters ("mm")×10 mm×3 mm. The Zr-based bulk amorphous alloy sample A6 was analyzed by Inductively Coupled Plasma Atomic Emission Spectrometer (ICP-AES) and was determined to have the following composition: $(Zr_{0.52}Al_{0.10}Cu_{0.30}Ni_{0.08})_{97.5}Y_{0.5}Sc_1Nb_1$.

Example 7

An alloy represented by the formula of $(Zr_{0.52}Al_{0.1}Cu_{0.3}Ni_{0.08})_{97.5}Y_{0.5}Sc_2$ was prepared as follows:

About 47.2652 g of Zr, about 2.6883 g of Al, about 18.9949 g of Cu, about 4.6785 g of Ni, about 0.4543 g of Y, and about 0.9188 g of Sc were weighed and placed in an arc melting furnace. The arc melting furnace was vacuumed until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous Alloy Sample No. A7 with a size of 200 millimeters ("mm")×10 mm×3 mm. The Zr-based bulk amorphous alloy sample A7 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{97.5}Y_{0.5}Sc_2$.

Example 8

An alloy represented by the formula of $(Zr_{0.48}Al_{0.11}Cu_{0.33}Ni_{0.08})_{98.5}Y_{0.5}Nb_1$ was prepared as follows:

About 45.6697 g of Zr, about 3.0954 g of Al, about 19.8832 g of Cu, about 4.8973 g of Ni, about 0.4707 g of Y, and about 0.9838 g of Nb were weighed and placed in an arc melting furnace. The arc melting furnace was vacuumed until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous Alloy Sample No. A8 with a size of 200 millimeters ("mm")×10 mm×3 mm. The Zr-based bulk amorphous alloy sample A8 was analyzed by Inductively Coupled Plasma Atomic Emission Spectrometer (ICP-AES) and was determined to have the following composition: $(Zr_{0.48}Al_{0.11}Cu_{0.33}Ni_{0.08})_{98.5}Y_{0.5}Nb_1$.

Example 9

An alloy represented by the formula of $(Zr_{0.52}Al_{0.1}Cu_{0.3}Ni_{0.08})_{98.7}Y_{0.3}Nb_{0.3}Sc_{0.1}Ta_{0.6}$ was prepared as follows:

About 47.0650 grams ("g") of Zr, about 2.6769 g of Al, about 18.9145 g of Cu, about 4.6587 g of Ni, about 0.2681 g of Y, about 0.2802 g of Nb, about 0.0452 g of Sc, and about 1.0914 g of Ta were weighed and placed in an arc melting furnace. The arc melting furnace was vacuumed until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous Alloy Sample No. A9 with a size of 200 millimeters ("mm")×10 mm×3 mm. The Zr-based bulk amorphous alloy sample A9 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{98.7}Y_{0.3}Nb_{0.3}Sc_{0.1}Ta_{0.6}$.

Example 10

An alloy represented by the formula of $(Zr_{0.52}Al_{0.1}Cu_{0.3}Ni_{0.08})_{97.5}Y_{0.5}Sc_{4/3}Nb_{2/3}$ was prepared as follows:

About 47.0602 g of Zr, about 2.6766 g of Al, about 18.9126 g of Cu, about 4.6582 g of Ni, about 0.4523 g of Y, about 0.6099 g of Sc, and about 0.6302 g of Nb were weighed and placed in an arc melting furnace. The arc melting furnace was vacuumized until a vacuum degree of about 1000 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous Alloy Sample No. A10 with a size of 200 millimeters ("mm")×10 mm×3 mm. The Zr-based bulk amorphous alloy sample A10 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{97.5}Y_{0.5}Sc_{4/3}Nb_{2/3}$.

Example 11

An alloy represented by the formula of $(Zr_{0.52}Al_{0.1}Cu_{0.3}Ni_{0.08})_{97.5}Y_{0.5}Ta_{1.6}Sc_{0.4}$ was prepared as follows:

About 45.5855 grams ("g") of Zr, about 2.6944 g of Al, about 18.4716 g of Cu, about 4.6927 g of Ni, about 0.4557 g of Y, about 2.9677 g of Ta, and about 0.1843 g of Sc were weighed and placed in an arc melting furnace. The arc melting furnace was vacuumed until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mould by high pressure casting under a pressure of about 20 MPa, to form a Zr-based bulk amorphous Alloy Sample No. All with a size of 200 millimeters ("mm")×10 mm×3 mm. The Zr-based bulk amorphous alloy sample A11 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{97.5}Y_{0.5}Ta_{1.6}Sc_{0.4}$.

Comparative Example 1

An alloy represented by the formula of $Zr_{0.52}Al_{0.1}Cu_{0.3}Ni_{0.08}$ comprises was prepared as follows:

About 48.1466 grams ("g") of Zr, about 2.7384 g of Al, about 19.3492 g of Cu, and about 4.7658 g of Ni were weighed and placed in an arc melting furnace. The arc melting furnace was vacuumed until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous alloy sample D1 with a size of 200 millimeters ("mm")×10 mm×3 mm. The Zr-based bulk amorphous Alloy Sample No. D1 was analyzed by Inductively Coupled Plasma Atomic Emission Spectrometer (ICP-AES) and was determined to have the following composition: $Zr_{0.52}Al_{0.1}Cu_{0.3}Ni_{0.08}$.

Comparative Example 2

An alloy represented by the formula of $(Zr_{0.52}Al_{0.1}Cu_{0.3}Ni_{0.08})_{99.5}Y_{0.5}$ was prepared as follows:

About 47.8573 grams ("g") of Zr, about 2.7219 g of Al, about 19.2329 g of Cu, about 4.7371 g of Ni and about 0.4507 g of Y were weighed and placed in an arc melting furnace. The arc melting furnace was vacuumed until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous alloy sample D2 with a size of 200 millimeters ("mm")×10 mm×3 mm. The Zr-based bulk amorphous Alloy Sample No. D2 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{99.5}Y_{0.5}$.

Comparative Example 3

An alloy represented by the formula of $(Zr_{0.52}Al_{0.1}Cu_{0.3}Ni_{0.08})_{98}Ta_2$ was prepared as follows:

About 45.8551 grams ("g") of Zr, about 2.6081 g of Al, about 18.4283 g of Cu, about 4.5389 g of Ni and about 3.5697 g of Ta were weighed and placed in an arc melting furnace. The arc melting furnace was vacuumized until a vacuum degree of about 50 Pa, and then argon with a purity of about 99% by volume was blown into the arc melting furnace as a protective gas. The raw materials were melted sufficiently at a temperature of about 2000° C. for about 2 minutes for 3 times to form a melted alloy.

The melted alloy was cast into a SKD61 metal mold by high pressure casting under a pressure of about 20 MPa, to form a Zr-based bulk amorphous alloy sample D3 with a size of 200 millimeters ("mm")×10 mm×3 mm. The Zr-based bulk amorphous Alloy Sample No. D3 was analyzed by Inductively Coupled Plasma Atomic Emission Spectrometer (ICP-AES) and was determined to have the following composition: $(Zr_{0.52}Al_{0.1}Cu_{0.3}Ni_{0.08})_{98}Ta_2$.

The compositions of the Alloy Samples Nos. A1-11, and D1-3 are summarized in Table 1.

Testing

1) X-Ray Diffraction (XRD)

Alloy Samples Nos. A1-5 and Alloy Samples D1-3 were tested by D-MAX2200PC X-ray powder diffractometer under the conditions of: a copper target, an incident wavelength of about 1.54060 Å, an accelerating voltage of about 40 KV, a current of about 20 mA, and a scanning step of about 0.04°respectively. The results are provided in FIG. 1.

2) Percent of Amorphous Phase

The phases of Alloy Sample Nos. A1-11 and D1-3 were each also analyzed by the D-MAX2200PC X-ray powder diffractometer under the conditions of: a copper target, an incident wavelength of about 1.54060 Å, an accelerating voltage of about 40 KV, a current of about 20 mA, and a scanning step of about 0.04° respectively. The results are provided in Table 2.

3) Critical Size

Alloy Sample Nos. A1-11 and D1-3 were cast into a shape of a wedge according to the methods in Examples 1-11 and Comparative Examples 1-3 respectively, and tested as follows: The edge of the wedge with a thickness of about 1 millimeter was cut to form a sectional surface, and the sectional surface was tested by XRD. If the XRD results indicated the cut sample was amorphous, the cutting was continued until the cut sample was not amorphous. The total cut thickness was recorded. The critical size was the total cut thickness minus 1 millimeter. The resulting critical sizes of Alloy Samples A1-11 and D1-3 are provided in Table 2.

4) Bending Strength

Alloy Sample Nos. A1-11 and D1-3 were each cut into a sheet with a size of 3 millimeters ("mm")×10 mm×90 mm, and the bending strength of each sheet was tested using a CMT5105 electronic universal testing machine under the conditions of: a span of about 50 millimeters and a loading speed of about 10-50 millimeters/second. The results are provided in Table 2.

5) Impact Toughness

Alloy Sample Nos. A1-11 and D1-3 were cut into a sheet with a size of 3 millimeters ("mm")×6 mm×15 mm, and the impact toughness of each sheet was tested by a ZBC50 pendulum impact tester with a simple supported beam and an impact power of 5.5 J. The results are provided in Table 2.

6) Oxygen Content

Alloy Sample Nos. A1-11 and D1-3 were tested by an IRO-II infrared oxygen analyzer under the conditions of: a carrier gas of nitrogen and a gas flow rate of about 10-30 L/min. The results are provided in Table 2.

TABLE 1

| Embodiment | Sample No. | Composition |
|---|---|---|
| Example 1 | A1 | $(Zr_{0.52}Al_{0.10}Cu_{0.30}Ni_{0.08})_{99}Y_{0.5}Nb_{0.5}$ |
| Example 2 | A2 | $(Zr_{0.52}Al_{0.10}Cu_{0.30}Ni_{0.08})_{98.5}Y_{0.5}Nb_{1}$ |
| Example 3 | A3 | $(Zr_{0.52}Al_{0.1}Cu_{0.3}Ni_{0.08})_{97.5}Y_{0.5}Ta_{2}$ |
| Example 4 | A4 | $(Zr_{0.52}Al_{0.1}Cu_{0.3}Ni_{0.08})_{99}Y_{0.5}Sc_{0.5}$ |
| Example 5 | A5 | $(Zr_{0.52}Al_{0.10}Cu_{0.30}Ni_{0.08})_{98.7}Y_{0.3}Nb_{1/3}Sc_{1/3}Ta_{1/3}$ |
| Example 6 | A6 | $(Zr_{0.52}Al_{0.10}Cu_{0.30}Ni_{0.08})_{97.5}Y_{0.5}Sc_{1}Nb_{1}$ |
| Example 7 | A7 | $(Zr_{0.52}Al_{0.10}Cu_{0.30}Ni_{0.08})_{97.5}Y_{0.5}Sc_{2}$ |
| Example 8 | A8 | $(Zr_{0.48}Al_{0.11}Cu_{0.33}Ni_{0.08})_{98.5}Y_{0.5}Nb_{1}$ |
| Example 9 | A9 | $(Zr_{0.52}Al_{0.1}Cu_{0.3}Ni_{0.08})_{98.7}Y_{0.3}Nb_{0.3}Sc_{0.1}Ta_{0.6}$ |
| Example 10 | A10 | $(Zr_{0.52}Al_{0.1}Cu_{0.3}Ni_{0.08})_{97.5}Y_{0.5}Sc_{4/3}Nb_{2/3}$ |
| Example 11 | A11 | $(Zr_{0.52}Al_{0.1}Cu_{0.3}Ni_{0.08})_{97.5}Y_{0.5}Ta_{1.6}Sc_{0.4}$ |
| Comparative Example 1 | D1 | $Zr_{0.52}Al_{0.10}Cu_{0.30}Ni_{0.08}$ |
| Comparative Example 2 | D2 | $(Zr_{0.52}Al_{0.10}Cu_{0.30}Ni_{0.08})_{99.5}Y_{0.5}$ |
| Comparative Example 3 | D3 | $(Zr_{0.52}Al_{0.10}Cu_{0.30}Ni_{0.08})_{98}Ta_{2}$ |

TABLE 2

| Alloy Sample No. | Percent of Amorphous Phase (%) | Critical Size (mm) | Bending Strength (Mpa) | Impact Toughness ($KJ/m^2$) | Preparing Vacuum Degree (Pa) | Oxygen Content (ppm) |
|---|---|---|---|---|---|---|
| A1 | 95 | 11 | 2388 | 140.515 | 50 | 500 |
| A2 | 98 | 11 | 2308 | 149.412 | 50 | 350 |
| A3 | 100 | 13 | 2489 | 144.894 | 50 | 300 |
| A4 | 98 | 15 | 2664 | 142.664 | 1000 | 1620 |
| A5 | 100 | 16 | 2701 | 167.709 | 1000 | 800 |
| A6 | 95 | 14 | 2577 | 148.855 | 1000 | 320 |
| A7 | 98 | 14 | 2438 | 150.232 | 1000 | 500 |
| A8 | 95 | 13 | 2358 | 146.267 | 1000 | 600 |
| A9 | 100 | 15 | 2689 | 166.709 | 1000 | 780 |
| A10 | 96 | 14 | 2574 | 147.855 | 1000 | 340 |
| A11 | 100 | 14 | 2551 | 146.754 | 50 | 350 |
| D1 | 5 | 2 | 920 | 40.623 | 50 | 500 |
| D2 | 14 | 2 | 1436 | 68.757 | 50 | 300 |
| D3 | 10 | 1 | 850 | 50.702 | 50 | 600 |

Although explanatory embodiments have been shown and described, it would be appreciated by those skilled in the art that changes, alternatives, and modifications can be made in the embodiments without departing from spirit and principles of the disclosure. Such changes, alternatives, and modifications all fall into the scope of the claims and their equivalents.

What is claimed is:

1. An alloy represented by a formula consisting essentially of:

$$(Zr_aAl_bCu_cNi_d)_{100-e-f}Y_eM_f$$

wherein a, b, c, and d are atomic fractions, in which $0.472 \le a \le 0.568$; $0.09 \le b \le 0.11$; $0.27 \le c \le 0.33$; $0.072 \le d \le 0.088$, and the sum of a, b, c, and d equals to 1;

e and f are atomic numbers of elements Y and M respectively, in which $0.01 \le e \le 5$, and $0.01 \le f \le 5$; and M is selected from the group consisting of Nb, Ta, Sc, and combinations thereof, wherein the alloy has an amorphous phase of more than about 95% by volume, wherein the alloy has an amorphous phase of more than about 95% by volume, wherein M is selected from the group consisting of: the combination of Sc and Nb, the combination of Sc and Ta, and the combination of Sc, Nb, and Ta, and wherein the atomic ratio of Sc to Nb ranges from about 1:from about 0.1 to about 5, the atomic ratio of Sc to Ta ranges from about 1:from about 0.1 to about 5, and the atomic ratio of Sc:Nb:Ta ranges from about 1:from about 0.1 to about 5:from about 0.1 to about 10.

2. The alloy of claim 1, wherein $0.05 \le f \le 2$.

3. The alloy of claim 1, further comprising: a metal impurity with an atomic percent of less than about 5% and a non-metal impurity with an atomic percent of less than about 1%, based on the total alloy.

4. The alloy of claim 1, wherein the alloy has a critical size of more than about 3 millimeters.

5. The alloy of claim 1, wherein the alloy has an oxygen content of less than about 3000 parts per million.

6. The alloy of claim 1, wherein the alloy has a critical size of more than about 10 millimeters, a bending strength of more than about 2,300 MPa, and an impact toughness of more than about 140 $KJ/m^2$.

7. The alloy of claim 1, wherein the alloy has an impact toughness of more than 140 $KJ/m^2$.

8. A method of preparing an alloy, comprising:

melting raw materials comprising Zr, Al, Cu, Ni, M, and Y, to form a melted alloy; and molding the melted alloy with cooling to form an alloy represented by a formula consisting essentially of: $(Zr_aAl_bCu_cNi_d)_{100-e-f}Y_eM_f$; wherein a, b, c, and d are atomic fractions, in which $0.472 \le a \le 0.568$; $0.09 \le b \le 0.11$; $0.27 \le c \le 0.33$; $0.072 \le d \le 0.088$, and the sum of a, b, c, and d equals to 1; e and f are atomic numbers of elements Y and M respectively, in which $0.01 \le e \le 5$, and $0.01 \le f \le 5$; and M is selected from the group consisting of Nb, Ta, Sc, and combinations thereof, wherein the alloy has an amorphous phase of more than about 95% by volume, wherein M is selected from the group consisting of: the combination of Sc and Nb, the combination of Sc and Ta, and the combination of Sc, Nb and Ta, and wherein the atomic ratio of Sc to Nb ranges from about 1:from about 0.1 to about 5, the atomic ratio of Sc to Ta ranges from about 1:from about 0.1 to about 5, and the atomic ratio of Sc:Nb:Ta ranges from about 1:from about 0.1 to about 5:from about 0.1 to about 10.

9. The method of claim 8 performed under a vacuum or in the presence of an inert gas, and wherein $0.05 \le f \le 2$.

10. The method of claim 9, wherein the vacuum degree is less than about 1,000 Pa.

11. The method of claim 8, wherein the raw materials of the alloy have a purity ranging from about 98 wt % to about 100 wt %.

12. The method of claim 8, wherein the alloy further comprises: a metal impurity with an atomic percent of less than about 5% and a non-metal impurity with an atomic percent of less than about 1%, based on the total alloy.

13. The method of claim 8, wherein the alloy has a critical size of more than about 3 millimeters.

14. The method of claim 8, wherein the alloy has an oxygen content of less than about 3000 parts per million.

15. The method of claim 8, wherein the inert gas is selected from the group consisting of helium, neon, argon, krypton, xenon, radon, and combinations thereof.

16. The method of claim 8, wherein the alloy has an impact toughness of more than 140 $KJ/m^2$.

* * * * *